US010953254B2

(12) United States Patent
Griffin et al.

(10) Patent No.: US 10,953,254 B2
(45) Date of Patent: Mar. 23, 2021

(54) SYSTEM AND METHOD FOR MONITORING AND CONTROLLING FIRE SUPPRESSION SYSTEMS IN COMMERCIAL KITCHENS

(71) Applicant: Captive-Aire Systems, Inc., Raleigh, NC (US)

(72) Inventors: William Brian Griffin, Columbia, PA (US); William Earle Glaub, Raleigh, NC (US); Brady Jay Ambrose, New Harmony, UT (US); Jesse Beard, Raleigh, NC (US)

(73) Assignee: Captive-Aire Systems, Inc., Raleigh, NC (US)

( * ) Notice: Subject to any disclaimer, the term of this patent is extended or adjusted under 35 U.S.C. 154(b) by 620 days.

(21) Appl. No.: 15/831,816

(22) Filed: Dec. 5, 2017

(65) Prior Publication Data

US 2019/0168045 A1 Jun. 6, 2019

(51) Int. Cl.

| | |
|---|---|
| ***A62C 37/50*** | (2006.01) |
| ***A62C 3/00*** | (2006.01) |
| *A62C 99/00* | (2010.01) |

(52) U.S. Cl.

CPC ..... *A62C 37/50* (2013.01); *A62C 3/006* (2013.01); *A62C 99/0009* (2013.01)

(58) Field of Classification Search

None

See application file for complete search history.

(56) References Cited

U.S. PATENT DOCUMENTS

| | | | | |
|---|---|---|---|---|
| 3,055,285 | A | 9/1962 | Gaylord | |
| 4,623,788 | A * | 11/1986 | Kern | G08B 17/12 250/227.11 |
| 4,784,114 | A | 11/1988 | Muckler et al. | |
| 5,642,784 | A | 7/1997 | Guay et al. | |
| 6,817,356 | B2 * | 11/2004 | Gallagher | F24C 15/20 126/299 D |
| 7,963,282 | B2 | 6/2011 | Griffin et al. | |
| 8,378,834 | B1 | 2/2013 | Glaub et al. | |
| 8,610,601 | B2 | 12/2013 | Glaub et al. | |
| 2002/0082924 | A1 * | 6/2002 | Koether | G06Q 10/06 705/15 |
| 2005/0178378 | A1 | 8/2005 | Marshall et al. | |

(Continued)

FOREIGN PATENT DOCUMENTS

WO 2009004332 A2 1/2009

OTHER PUBLICATIONS

Espacenet.com machine translation of KR101713232B1, Kim Jong Seok, Mar. 7, 2017, "Commercial Automatic Fire Extinguishing Appratus(sic)" (Year: 2020).*

*Primary Examiner* — Gregory J Toatley, Jr.

*Assistant Examiner* — Denise R Karavias

(74) *Attorney, Agent, or Firm* — Coats & Bennett PLLC

(57) ABSTRACT

Disclosed herein is a system and process for monitoring and controlling fire suppression systems in commercial kitchens. Repeatedly various components of the fire suppression systems are tested for faults. When a fault is detected in a particular component, the fault is communicated through a communications module associated with the commercial kitchen via the internet to one or more remote servers. Upon receiving information indicating a particular fault, the one or more remote servers acts to alert interested parties of the default.

4 Claims, 9 Drawing Sheets

(56) References Cited

U.S. PATENT DOCUMENTS

| | | | | |
|---|---|---|---|---|
| 2013/0048319 | A1* | 2/2013 | Glaub | F24C 15/2057 169/65 |
| 2013/0341053 | A1* | 12/2013 | Rouse | A62C 35/605 169/23 |
| 2015/0140913 | A1* | 5/2015 | Livchak | F24C 15/20 454/67 |
| 2015/0226439 | A1* | 8/2015 | Mikulec | A62C 3/006 99/337 |

* cited by examiner

SYSTEM AND METHOD FOR MONITORING AND CONTROLLING FIRE SUPPRESSION SYSTEMS IN COMMERCIAL KITCHENS

FIELD OF THE INVENTION

The present invention relates to systems and methods for monitoring and controlling fire suppression systems, and more particularly to monitoring and controlling fire suppression systems employed in commercial kitchens.

Most commercial kitchens include fire suppression systems that protect buildings and people occupying the buildings. Typically commercial kitchen fire suppression systems include fusible links, heat sensors, manual switches, other forms of fire detectors, control valves, etc.

Once installed, commercial kitchen fire suppression systems are typically not altered. They are kept serviceable through routine maintenance. Unfortunately, routine maintenance can result in components of fire suppression systems being removed and/or not replaced properly. In addition, such fire suppression systems include critical components that must operate and operate properly when called upon by fire detectors detecting a fire. Maintenance personnel may periodically test commercial kitchen fire suppression systems including sensors, valves, etc. to insure that the system components are operating properly. However, there is no way to determine if a sensor or valve is operative by simply carrying out a visual inspection. Instead at best maintenance personnel must at least actuate part of the fire suppression system and then determine if the components are operating properly and also verify that the system is reflecting, by emitting an alarm, for example, their proper operation. There are many valves, sensors and other components in a typical commercial kitchen fire suppression system that requires testing in order to identify faults. Thus, if manual inspection is solely relied upon, then this becomes a laborious and time-consuming endeavor, not to mention the concern as to whether manual inspections are entirely reliable.

Therefore, there is a need for a reliable automatic monitoring and control system for commercial kitchen fire suppression systems that detect faults in components, appraise interested parties of the detected fault, and respond to detected faults by appropriately shutting down appliances in the commercial kitchen. There is also a need for this type of monitoring and control to be carried out in a more efficient way. As discussed below, disclosed herein is a remote monitoring and control system that enables a large number of fire suppression systems located in commercial kitchens in different geographic locations to be continuously monitored from a remote site.

SUMMARY OF THE INVENTION

The following presents a simplified summary of the disclosure in order to provide a basic understanding to those of skill in the art. This summary is not an extensive overview of the disclosure and is not intended to identify key/critical elements of embodiments of the disclosure or to delineate the scope of the disclosure. The sole purpose of this summary is to present some concepts disclosed herein in a simplified form as a prelude to the more detailed description that is presented later.

The present invention relates to a system and method for monitoring and controlling fire suppression systems in commercial kitchens. Repeatedly various components of the fire suppression systems are tested for faults. Certain components of the fire suppression systems are deemed more critical or important than others. When a fault is detected in certain components denoted critical, for example, the monitoring and control system automatically disables appliances such as stoves, grills, etc. in the kitchen.

In one embodiment, the fire suppression systems installed in commercial kitchens located in different geographic areas are remotely monitored. One or more servers located on remote server sites receives information via the internet from communication modules located at the sites of various commercial kitchens. Controllers associated with the commercial kitchens continuously monitor components of the associated fire suppression systems. When a fault is detected in a component of a fire suppression system, a fault notice or fault status information is transmitted from the controller to an associated communications module which, in turn, communicates the fault notice to the remote server. The fault notice identifies the particular fire suppression system implicated, as well as the particular component in that fire suppression system that is determined to be faulty. In response, the remote server appraises one or more interested parties, such as the owner or manager of the commercial kitchen of the fault.

Other objects and advantages of the present invention will become apparent and obvious from a study of the following description and the accompanying drawings which are merely illustrative of such invention.

BRIEF DESCRIPTION OF THE DRAWINGS

The present disclosure is described more fully with reference to the accompanying drawings, in which various embodiments of the disclosure are shown. However, this disclosure should not be construed as limited to the embodiments set forth herein. Rather, these embodiments are provided so that this disclosure will be thorough and complete, and will fully convey the scope of the disclosure to those skilled in the art. Like numbers refer to like elements throughout.

DETAILED DESCRIPTION OF THE INVENTION

Figure 1:
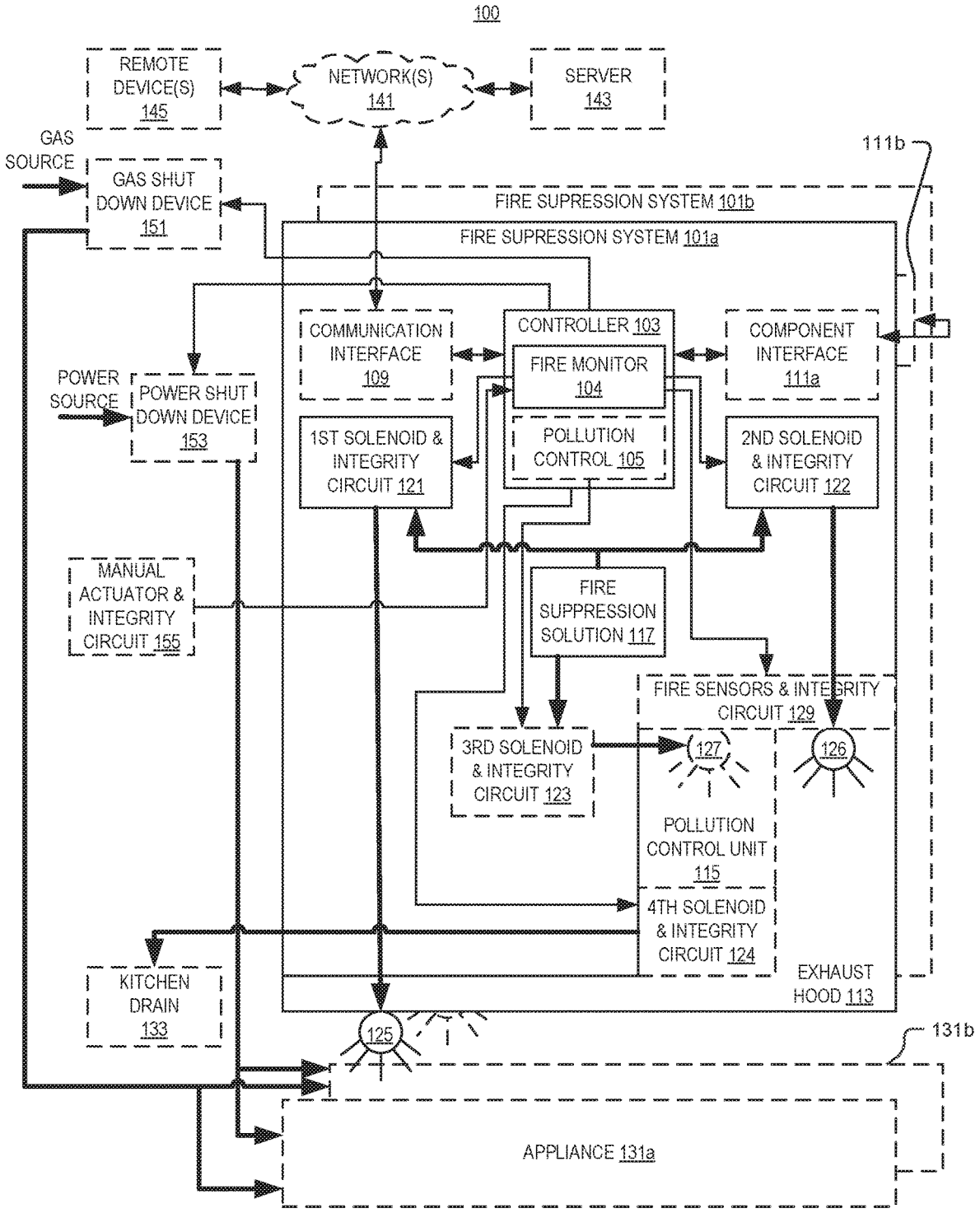
FIG. 1 illustrates one embodiment of a system for monitoring and controlling fire suppression systems in commercial kitchens in accordance with various aspects as described herein.

For simplicity and illustrative purposes, the present disclosure is described by referring mainly to an exemplary embodiment thereof. In the following description, numerous specific details are set forth in order to provide a thorough understanding of the present disclosure. However, it will be readily apparent to one of ordinary skill in the art that the present disclosure may be practiced without limitation to these specific details. In this description, well known methods and structures have not been described in detail so as not to unnecessarily obscure the present disclosure.

It may be beneficial to briefly review a commercial kitchen and a fire suppression system for extinguishing fires that might be found in the commercial kitchen. Generally, a commercial kitchen will have at least one exhaust hood that overlies one or more appliances. These appliances may include cooktops, grills, etc. They can be gas fired or powered by electricity. Typically exhaust hoods include grease filters and fans for inducing air to move over and around the appliances and up through the exhaust hood. Grease filters in the exhaust hood remove grease and oil from the air being exhausted.

Downstream from the exhaust hood in some cases is what is referred to as a pollution control unit. The pollution control unit includes a duct system for directing the air from the outlet of the exhaust hood through the pollution control unit. The pollution control unit typically includes filters for removing contaminants from the air exhausted by the exhaust hood in the commercial kitchen.

Fire suppression systems are typically associated with the exhaust hoods and in some cases fire suppression systems are installed in pollution control units. The function, of course, of such fire suppression systems is to suppress and extinguish fires in the exhaust hoods, pollution control units and on and around appliances.

The fire suppression systems include networks of sprinkler heads that are aimed at areas in the exhaust hood and areas of the pollution control units. As described herein, in one embodiment of the present invention, there is provided separate sprinkler heads for the exhaust hood and the appliances. That is, the fire suppression system includes dedicated sprinkler heads for the exhaust hood and at least one dedicated sprinkler head for the appliances. Also in cases where there is a downstream pollution control unit, there is a separate sprinkler head system for the pollution control unit.

In the event of a fire in a commercial kitchen, the fire suppression system is designed to emit a fire suppression solution from the various sprinkler heads forming a part of the system. In many cases the fire suppression solution is simply water. In other cases, the fire suppression solution may include a chemical solution.

As discussed below, various control elements in the fire suppression system control the flow of the fire suppression solution to sprinkler heads in the event of a fire. For example, there is provided a system controller that not only monitors various components and elements of the fire control system for faults but also is operative to cause the fire suppression solution to be dispersed in the event of a fire. The fire suppression system includes electric solenoid valves that control the flow of the fire suppression solution in the event of a fire and other components, such as pumps. Also as will be discussed, there are other elements that form a part of the fire suppression system, such as supervision circuits for determining faults. As described in more detail below, a system controller continuously monitors these components for faults. For a complete and unified understanding of a typical fire suppression system for a commercial kitchen, one is referred to the disclosure of U.S. Pat. No. 8,378,834, the disclosure of which is expressly incorporated herein by reference.

This disclosure describes systems and methods for monitoring and controlling fire suppression systems employed in commercial kitchens. For example, FIG. 1 illustrates one embodiment of a system 100 for monitoring and controlling fire suppression systems in commercial kitchens in accordance with various aspects as described herein. In FIG. 1, system 100 includes one or more fire suppression systems 101*a,b* with each having an exhaust hood 113 that is positioned above corresponding appliances 131*a,b* in a commercial kitchen. Each fire suppression system 101*a,b* is configured to shut down corresponding kitchen appliances 131*a,b* in the commercial kitchen responsive to detecting certain faults such as detecting a fire in the kitchen or detecting a faulty sensor or solenoid. Each fire suppression system 101*a,b* may further include a controller 103, a communication interface or module 109, a component interface or module 111*a,b*, a fire suppression solution 117 (contained in a container), electric solenoid and integrity circuits 121-124, sprinkler heads 125-127, a pollution control unit 115, a fire sensor(s) and integrity circuit 129, the like, or any combination thereof. Pollution control unit 115 is typically disposed downstream of the exhaust hood 113 and generally includes one or more filters for removing contaminants from the air stream exhausted by the hood. That is, air exhausted through the hood 113 is directed into and through the pollution control unit 115 where the one or more filters therein remove contaminants from the air. Further, the pollution control unit 115 may include a second fire suppression system. The controller 103 may include a fire monitor circuit, unit, or module 104 (hereafter fire monitor circuit) for monitoring and detecting faults in the fire suppression system 101*a* and shutting down the appliance 131*a* responsive to selected faults. Also, the controller 103 may include a pollution control circuit, unit, or module 105 (hereafter pollution control circuit) for removing contaminants from vapor or air exhausted by the hood 113.

In FIG. 1, controller 103 may be a single controller or two or more controllers. Further, controller 103 may include one or more processors. Each processor may be configured to process computer instructions and data. Further, each processor may be configured as any sequential state machine operative to execute machine instructions stored as machine-readable computer programs in the memory, such as one or more hardware-implemented state machines (e.g., in discrete logic, FPGA, ASIC, etc.); programmable logic together with appropriate firmware; one or more stored-program, general-purpose processors, such as a microprocessor or Digital Signal Processor (DSP), together with appropriate software; or any combination of the above.

In this embodiment, the fire sensor(s) and integrity circuit 129 may be mounted on, in, or about the hood 113, such that each sensor is operative to be activated by a fire associated with the appliance 131*a,b*, the hood 113, the pollution control unit 115, or the kitchen. In one embodiment, a fire sensor may include an active sensing element extending at least partially in the hood 113 or the pollution control unit 115. Each fire sensor may be of various extant designs that provide an electrical signal that may be used to initiate operation of the fire suppression system 101*a,b*. The controller 103 (such as via the fire monitor circuit 104) may repeatedly test the integrity of each fire sensor via its integrity circuit, collectively the fire sensor(s) and integrity circuit 129, to determine whether it has a fault. For instance, controller 103 may sense the presence of each fire sensor, monitor the electrical conductivity of each fire sensor, monitor electrical connections associated with each fire sensor, or the like to determine whether each fire sensor has a fault. In one example, the fire sensor(s) and integrity circuit 129 may include parallel conductors and a series of parallel switches coupled between the conductors to operatively couple to each fire sensor. Controller 103 may test the integrity of each fire sensor by selectively controlling the series of parallel switches. Controller 103 may test the integrity of each fire sensor repeatedly such as every second, minute, hour, or day. In one example, controller 103 periodically tests the integrity of each fire sensor. Also, controller 103 may monitor each fire sensor to determine whether it has detected a fire.

In addition, the controller 103 (such as via the fire monitor circuit 104) may repeatedly test the integrity of a manual actuator (i.e. a manual actuator for the fire suppression system 101) via its integrity circuit, collectively the actuator and integrity circuit 155, to determine whether it has a fault. For instance, the controller 103 may sense the presence of the actuator, monitor the electrical conductivity associated with the actuator, monitor electrical connections associated with the actuator, or the like to determine whether the actuator has a fault. Also, the controller 103 may monitor the manual actuator to determine whether it has been actuated. A skilled artisan will readily recognize various techniques for testing the integrity of a sensor, solenoid, actuator, or the like.

In FIG. 1, controller 103 (such as via the fire monitor circuit 104) may repeatedly test the integrity of a first electric solenoid valve via a first integrity circuit, with both forming the first solenoid valve and integrity circuit 121. For instance, the controller 103 may sense the presence of the first electric solenoid valve, monitor the electrical conductivity associated with the solenoid valve, monitor electrical connections associated with the solenoid valve, or the like to determine whether the solenoid valve has a fault. The first electric solenoid valve controls the flow of the fire suppression solution 117 to at least one sprinkler head 125 disposed over the appliance 131*a* in the commercial kitchen. Further, the first electric solenoid valve is operative to spray the fire suppression solution 117 onto the underlying appliance 131*a* responsive to a fire being detected by the fire suppression system 101*a* via the fire sensor(s) and integrity circuit 129.

Similarly, controller 103 (such as via the fire monitor circuit 104) may repeatedly test the integrity of a second electric solenoid valve via a second integrity circuit, with both forming the second solenoid valve and integrity circuit 122. For instance, the fire monitor circuit 104 may sense the presence of the second electric solenoid valve, monitor the electrical conductivity associated with the solenoid valve, monitor electrical connections associated with the solenoid valve, or the like to determine whether the solenoid valve has a fault. Second electric solenoid valve is disposed in the exhaust hood and controls the flow of the fire suppression solution 117 to the at least one sprinkler head 126 disposed in the exhaust hood 113.

Furthermore, controller 103 (such as via the pollution control circuit 105) may repeatedly test the integrity of a third electric solenoid valve via a third integrity circuit, with both forming the third solenoid and integrity circuit 123. For instance, controller 103 may sense the presence of the third electric solenoid valve, monitor the electrical conductivity associated with the solenoid valve, monitor electrical connections associated with the solenoid valve, or the like to determine whether the solenoid valve has a fault. Third electric solenoid valve controls the flow of the fire suppression solution 117 to one sprinkler head 127 attached to or disposed in the pollution control unit 115. The third electric solenoid valve is operative to spray the fire suppression solution 117 into the pollution control unit 115 responsive to a fire being detected by the fire suppression system 101*a*.

Similarly, controller 103 (such as via the pollution control circuit 105) may repeatedly test the integrity of a fourth electric solenoid valve via a fourth integrity circuit, with both forming the fourth solenoid valve and integrity circuit 124. For instance, the controller 103 may sense the presence of the fourth electric solenoid valve, monitor the electrical conductivity associated with the solenoid valve, monitor electrical connections associated with the solenoid valve, or the like to determine whether the solenoid valve has a fault. Fourth electric solenoid valve is operative to drain the fire suppression solution 117 sprayed into the pollution control unit 115.

In the current embodiment, if the controller 103 (such as via the fire monitor circuit 104) detects a fault in the first or second solenoid valve, it disables the appliance 131*a*. The integrity of the controller 103 may be tested using, for instance, a watchdog timer. In one example, upon detecting a fault, the fire monitor circuit 104 may control a power source shut down device 153 to disable power being provided to an electric appliance 131*a*. In another example, upon detecting a fault, the fire monitor circuit 104 may control a gas source shut down device 151 to prevent gas from being directed to the gas appliance 131*a*, for example. In a case where the appliance is a gas stove, the gas source shutdown device 151, in the event of a fire, may close and shutdown a gas control valve that controls the flow of gas to the gas appliance. Similarly, if the controller 103 (such as via the pollution control circuit 105) detects a fault in the third or fourth solenoid valve, it may disable the appliance 131*a*. The integrity of the controller 103 or the second controller may be tested using, for instance, the same or different watchdog timer as the first controller. In one example, upon detecting a fault, the pollution control circuit 105 may control the power source shut down device 153 to disable power being provided to the electric appliance 131*a*. In another example, upon detecting a fault, the pollution control circuit 105 may control the gas source shut down device 151 to disable gas being provided to the gas appliance 131*a*.

In FIG. 1, the communication interface 109 is configured to communicate with one or more remote devices 145, one or more servers 143, or the like via a network 141 (e.g., Internet). The communication interface 109 may be configured to include a receiver and a transmitter used to communicate with one or more other nodes over a communication network according to one or more communication protocols known in the art or that may be developed, such as Ethernet, TCP/IP, SONET, ATM, or the like. Further, the communication interface 109 may implement receiver and transmitter functionality appropriate to the communication network links (e.g., wireless, optical, electrical, or the like). The transmitter and receiver functions may share circuit components, software or firmware, or alternatively may be implemented separately. Network 141 may encompass wired and wireless communication networks such as a local-area network (LAN), a wide-area network (WAN), a computer network, a wireless network, a telecommunications network, another like network or any combination thereof. For example, the network 141 may be a Wi-Fi network. In another example, the network 141 may be a cellular network. The one or more remote devices 145 may communicate with the fire suppression system 101*a* via the communication interface 109 to configure, monitor, and/or control the fire suppression system 101*a*, including the fire monitor circuit 104 and/or the pollution control circuit 105. In addition, when multiple fire suppression systems 101*a,b* are communicatively linked via their component interfaces 111*a,b*, the one or more remote devices 145 can communicate with these multiple fire suppression systems 101*a,b* via the communication interface 109. Accordingly, all of the fire suppression systems 101*a,b* may be configured, monitored, and/or controlled using the one or more remote devices 145 via the communication interface 109 of the fire suppression system 101*a*.

Moreover, the server 143 may be located at a remote site (e.g., located at a different geographical location than the fire suppression systems 101*a,b*). Server 143 may be configured to receive information from the communication interface 109 of the fire suppression system 101*a* via the network 141. This information may indicate one or more faults, including a fault with respect to any of the solenoid valves 121-124, the controller 103, or the first and second controllers of the controller 103. Server 143 may determine whether the received information indicates that a fault has been detected in any of these solenoid valves 121-124 or controllers. If so, the server 143 may send an indication (e.g., text message, e-mail alert, E911 message, or the like) to interested parties. For example, an interested party may be an owner of a restaurant having the commercial kitchen in which a fire is being detected or the manager of such a restaurant.

Figure 2:
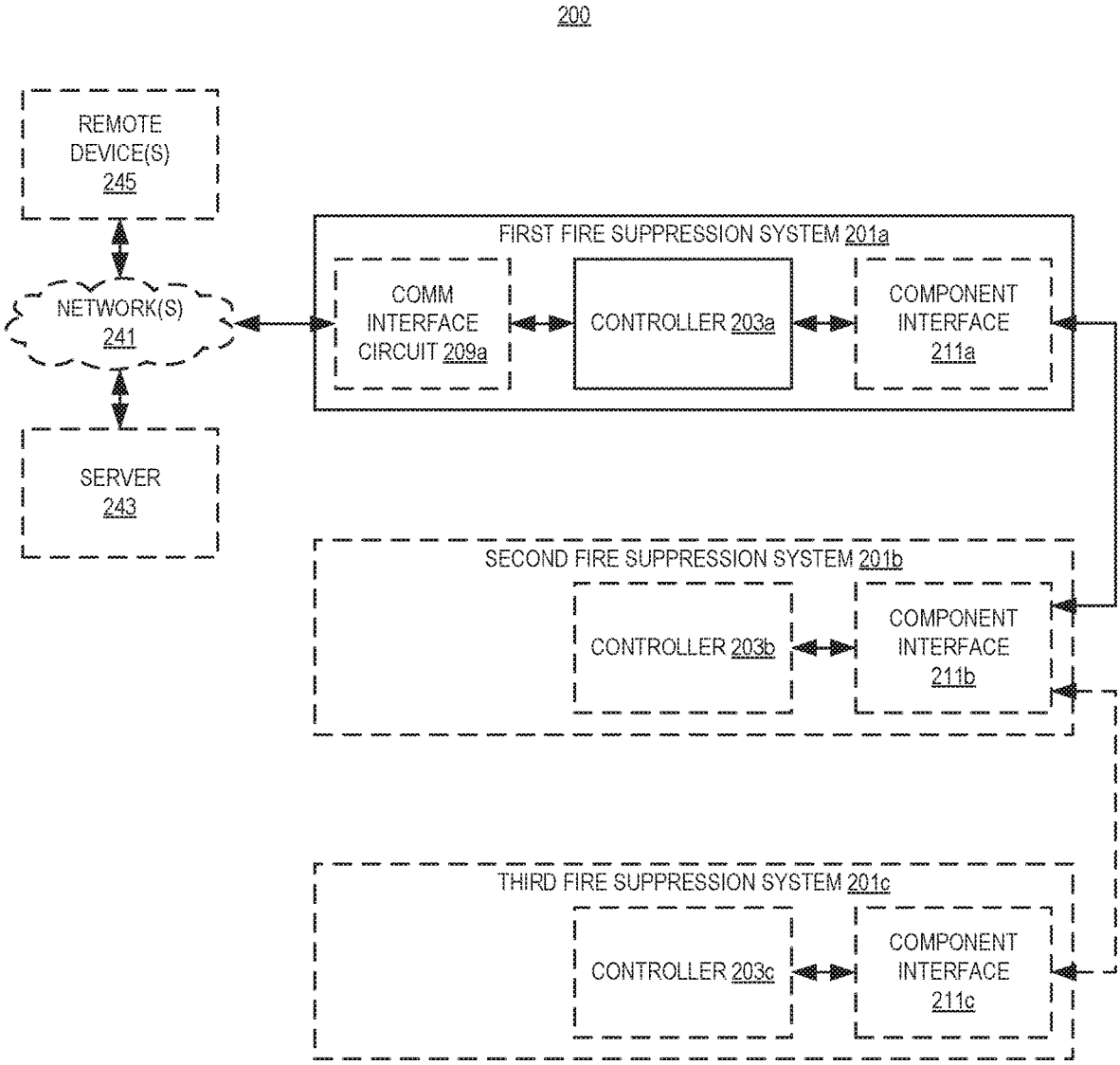
FIG. 2 illustrates another embodiment of a system for monitoring and controlling fire suppression systems in commercial kitchens in accordance with various aspects as described herein.

FIG. 2 illustrates another embodiment of a system 200 for monitoring and controlling fire suppression systems 201*a-c* in commercial kitchens in accordance with various aspects as described herein. In FIG. 2, the fire suppression systems 201*a-c* may be communicatively coupled via their respective component interfaces 211*a-c*, which are controlled by their respective controllers 203*a-c*. Further, the first fire suppression system 201*a* includes a communication interface circuit or module 209*a* for communicating information related to any of the fire suppression systems 201*a-c* with a remote server 243 via a network 241 (e.g., Internet). Each fire suppression system 201*a-c* may have a unique identifier (e.g., media access control (MAC) address) that identifies each fire suppression system 201*a-c* so that all of the fire suppression systems 201*a-c* may be continuously monitored by a remote server 243 via the network 241.

In FIG. 2, the server 243 may receive, from the communication interface circuit or module 209*a*, information that indicates a fault or a problem at a particular fire suppression system 201*a-c* and in response, may send an indication to actuate various alarms at the location of that fire suppression system, or may send a message (e.g., text messages, e-mails, alerts) concerning the status of that fire suppression system. For example, the server 243 may receive, from the communication circuit or module 209*a*, an indication of a fault with respect to a first electric solenoid valve of one of the fire suppression systems 201*a-c* that controls the flow of a fire suppression solution to at least one sprinkler head (disposed in that fire suppression system) over a corresponding appliance in the kitchen and operative to spray the fire suppression solution onto that appliance in response to a fire being detected in the kitchen. In another example, the server 243 may receive, from the communication circuit or module 209*a*, an indication of a fault with respect to a second electric solenoid valve in one of the fire suppression systems 201*a-c* that controls the flow of a fire suppression solution to at least one sprinkler head disposed in an exhaust hood of that fire suppression system and operative to spray the fire suppression solution into the exhaust hood in response to a fire being detected in the kitchen. In response to receiving the indication, the server 243 may determine whether the information received by the server 243 indicates that a fault has been detected in the first solenoid valve or the second solenoid valve. The server 243 may send an indication (e.g., text message, e-mail, alert) that a fault has been detected responsive to determining that the received information indicates a fault.

Figure 3:
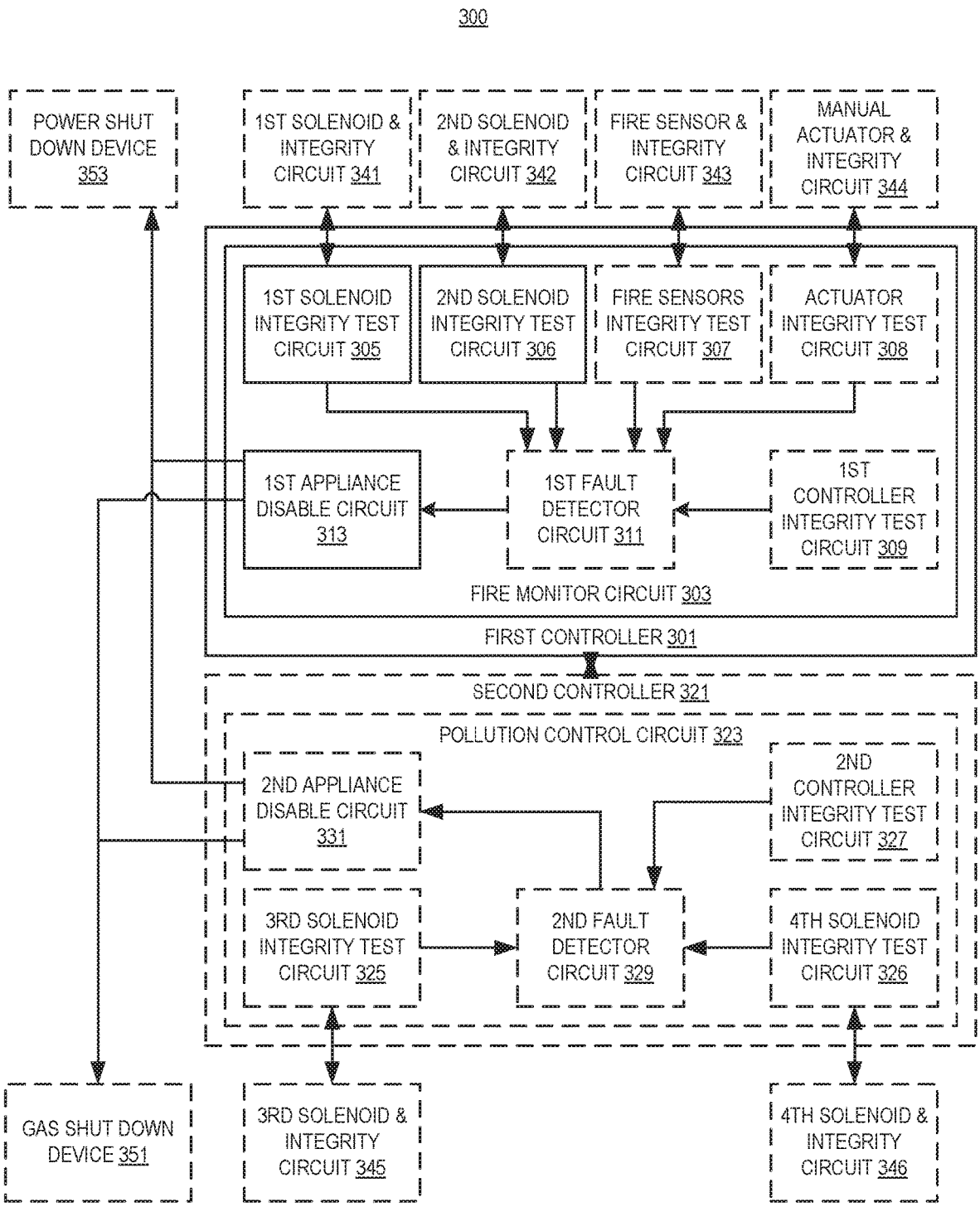
FIG. 3 illustrates one embodiment of a controller for monitoring and controlling fire suppression systems in commercial kitchens in accordance with various aspects as described herein.

FIG. 3 illustrates one embodiment of a controller 300 for monitoring and controlling fire suppression systems in commercial kitchens in accordance with various aspects as described herein. In FIG. 3, the controller 300 may include one or more controllers 301 that are interfaced to various sensors, solenoids, actuators, or the like. A first controller 301 may include a fire monitor circuit 303 configured to detect faults in the fire suppression system and shutting down a corresponding appliance in response to detecting selected faults. Fire monitor circuit 303 may include solenoid valve integrity test circuits 305-306, a fire sensor(s) integrity test circuit 307, an actuator(s) integrity test circuit 308, a controller integrity test circuit 309, a fault detector circuit 311, an appliance disable circuit 313 or any combination thereof. Each solenoid valve integrity circuit 305-306 may be coupled to a corresponding solenoid and its integrity circuit, collectively a solenoid and integrity circuit 341-342. Further, each solenoid integrity circuit 305-306 may repeatedly test the integrity of the corresponding solenoid via its integrity circuit.

In this embodiment, the fire sensor(s) integrity test circuit 307 may be coupled to a corresponding fire sensor(s) and integrity circuit, collectively a fire sensor(s) and integrity circuit 343. The fire sensor(s) integrity test circuit 307 may repeatedly test the integrity of the corresponding fire sensor(s) via its integrity circuit. The actuator(s) integrity test circuit 308 may be coupled to a corresponding manual actuator(s) and its integrity circuit, collectively a manual actuator and integrity circuit 344. The actuator integrity test circuit 308 may repeatedly test the integrity of the corresponding actuator(s) and its integrity circuit. The controller integrity test circuit 309 may repeatedly test the integrity of the first controller 301. The fault detector circuit 311 may determine whether there is a fault based on integrity test information received from the integrity test circuits 305-309. If a fault is detected, the fault detector circuit 311 sends an indication to the appliance disable circuit 313. In response, the appliance disable circuit 313 sends an indication to activate a gas shut down device 351 or a power shut down device 353 so as to remove gas or power from a corresponding appliance.

In FIG. 3, the second controller 321 may include a pollution control circuit 323 for controlling the cleaning of one or more filters operable to remove contaminants from the air stream exhausted by an exhaust hood. Alternatively, the first controller 301 may include the pollution control circuit 323. The pollution control circuit 323 may include solenoid valve integrity test circuits 325-326, a controller integrity test circuit 327, a fault detector circuit 329, an appliance disable circuit 331, the like, or any combination thereof. Each solenoid integrity circuit 325-326 may be coupled to a corresponding solenoid and its integrity circuit, collectively a solenoid and integrity circuit 345-346. Further, each solenoid integrity circuit 325-326 may repeatedly test the integrity of the corresponding solenoid valve via its integrity circuit. The controller integrity test circuit 327 may repeatedly test the integrity of the second controller 321. The fault detector circuit 329 may determine whether there is a fault based on integrity test information received from the integrity test circuits 325-327. If a fault is detected, the fault detector circuit 329 sends an indication to the appliance disable circuit 331. In response, the appliance disable circuit 331 sends an indication to activate a gas shut down device 351 or a power shut down device 353 so as to remove gas or power from a corresponding appliance.

Figure 4:
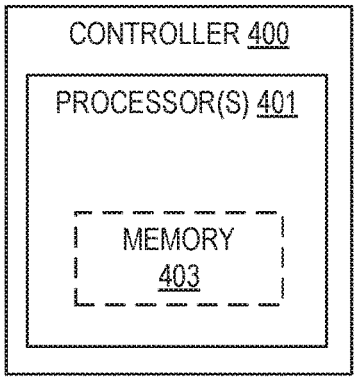
FIG. 4 illustrates a controller for monitoring and controlling fire suppression systems in commercial kitchens in accordance with various aspects as described herein.

FIG. 4 illustrates a controller 400 for monitoring and controlling fire suppression systems in commercial kitchens in accordance with various aspects as described herein. In FIG. 4, controller 400 may include processing circuit(s) 401. The processing circuit(s) 401 may be configured to perform processing as described herein (e.g., the method of FIG. 7) such as by executing program instructions stored in a memory 403. The processing circuit(s) 401 in this regard may implement certain functional means, units, or modules.

Figure 5:
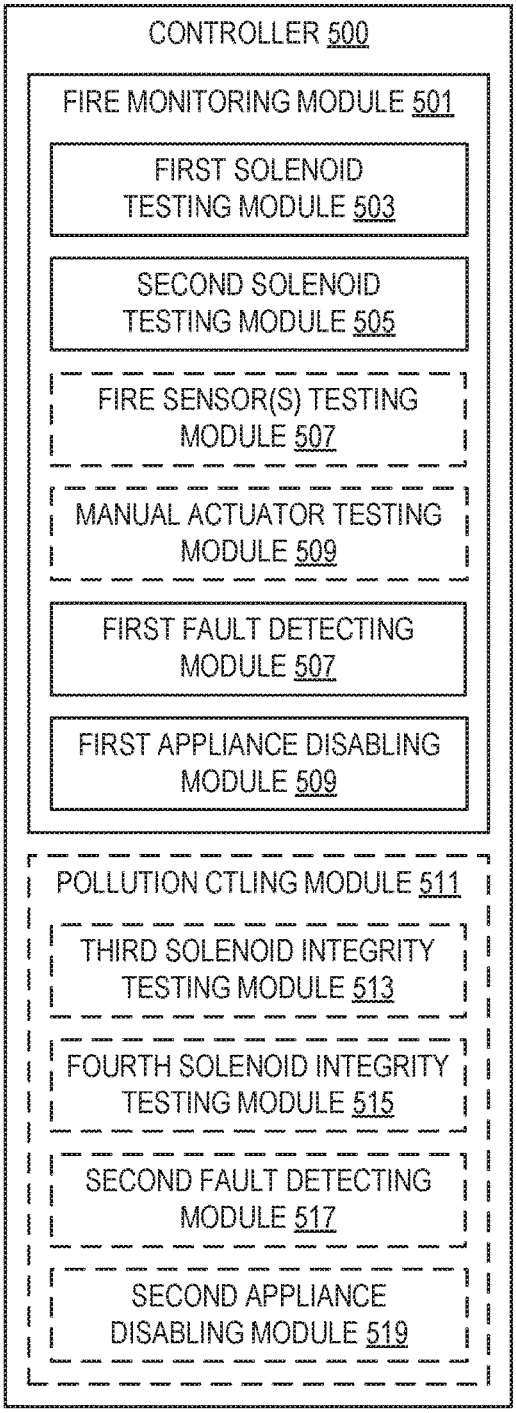
FIG. 5 illustrates another embodiment of a controller for monitoring and controlling fire suppression systems in commercial kitchens in accordance with various aspects as described herein.

FIG. 5 illustrates another embodiment of a controller 500 for monitoring and controlling fire suppression systems in commercial kitchens in accordance with various aspects as described herein. In FIG. 5, the controller 500 may implement various functional means, units, or modules (e.g., via the processing circuit(s) 401 of FIG. 4 or via software code). These functional means, units, or modules (e.g., for implementing the method of FIG. 7) include a fire monitoring module or unit 501 for monitoring and controlling the fire suppression systems in the commercial kitchens. These functional means, units, or modules include a first solenoid monitoring module or unit 503 for repeatedly testing the integrity of a first electric solenoid valve that controls the flow of a fire suppression solution to at least one sprinkler head disposed over an appliance in the kitchen and operative to spray the fire suppression solution onto the underlying appliance in response to a fire being detected in the kitchen. Further, these functional means, units, or modules include a second solenoid monitoring module or unit 505 for repeatedly testing the integrity of a second electric solenoid valve that controls the flow of a fire suppression solution to at least one sprinkler head disposed in an exhaust hood disposed over the appliance and operative to spray the fire suppression solution into the hood in response to a fire being detected in the kitchen. Also, these functional means, units, or modules include a first fault detecting module or unit 507 for determining whether a fault is detected in the first solenoid or the second solenoid. In addition, these functional means, units, or modules include a first appliance disabling module or unit 509 for disabling the appliance when a fault is detected in the first solenoid, the second solenoid, or the controller.

In FIG. 5, these functional means, units, or modules may include a pollution controlling module or unit 511 for removing contaminants from vapor exhausted by the hood of the kitchen appliance. These functional means, units, or modules may include a third solenoid monitoring module or unit 513 for repeatedly testing the integrity of a third electric solenoid valve that controls the flow of the fire suppression solution to a sprinkler head disposed in a pollution control unit of the hood and having a second fire suppression system, the pollution control unit being operative to permit the fire suppression solution to be sprayed into the pollution control unit in response to a fire being detected in the kitchen. Further, these functional means, units, or modules may include a fourth solenoid monitoring module or unit 515 for repeatedly testing the integrity of a fourth electric solenoid valve operative to drain the fire suppression solution from the pollution control unit. Also, these functional means, units, or modules may include a first fault detecting module or unit 517 for determining whether a fault is detected in the first solenoid or the second solenoid. In addition, these functional means, units, or modules may include a second appliance disabling module or unit 519 for disabling the appliance when a fault is detected in the third solenoid or the fourth solenoid.

Figure 6:
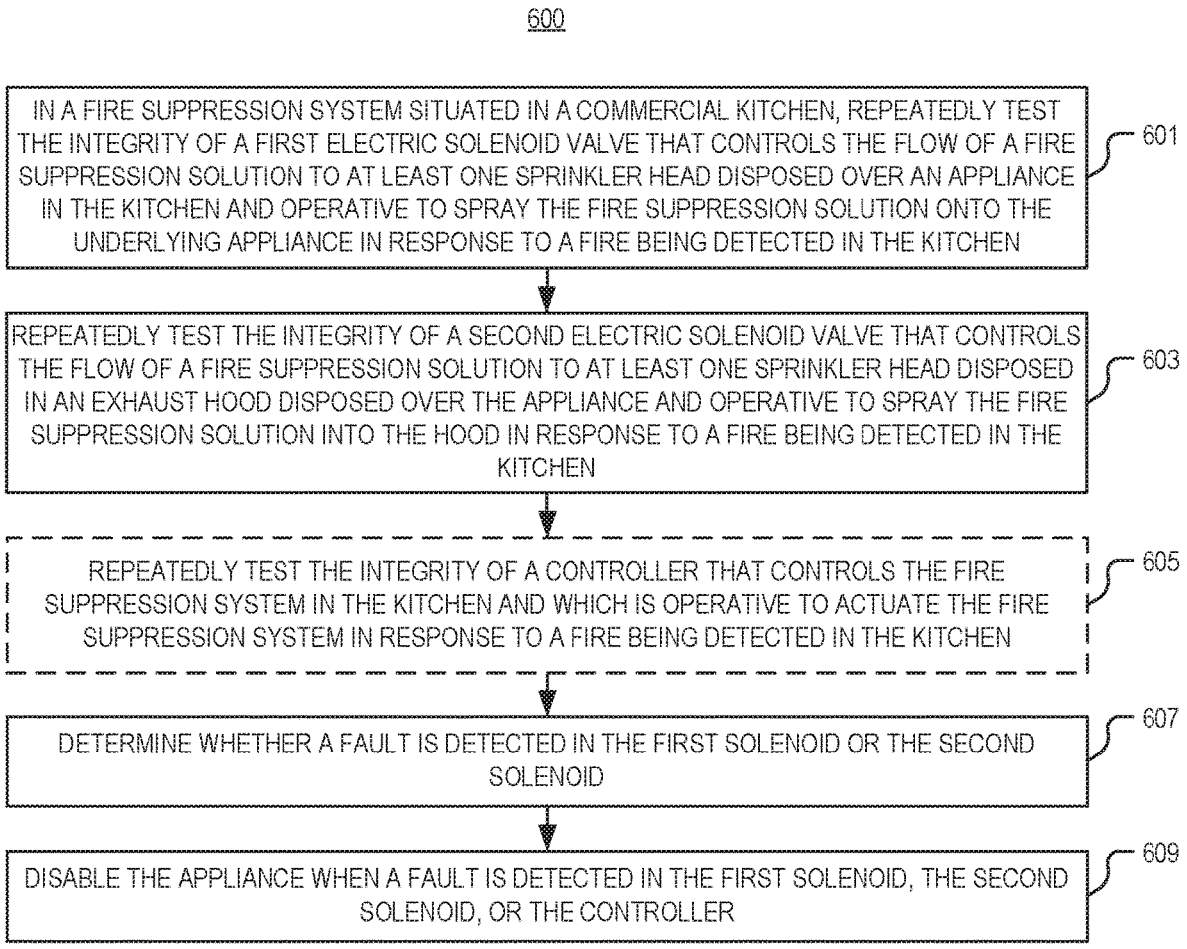
FIG. 6 illustrates one embodiment of a method performed by a controller for monitoring and controlling fire suppression systems in commercial kitchens in accordance with various aspects as described herein.

FIG. 6 illustrates one embodiment of a method 600 performed by a controller for monitoring and controlling fire suppression systems in commercial kitchens in accordance with various aspects as described herein. In FIG. 6, the method 600 may start, for instance, at block 601 where it includes repeatedly testing the integrity of a first electric solenoid valve that controls the flow of a fire suppression solution to at least one sprinkler head disposed over an appliance in the kitchen and operative to spray the fire suppression solution onto the underlying appliance in response to a fire being detected in the kitchen. At block 603, the method 600 includes repeatedly testing the integrity of a second electric solenoid valve that controls the flow of a fire suppression solution to at least one sprinkler head disposed in an exhaust hood disposed over the appliance and operative to spray the fire suppression solution into the hood in response to a fire being detected in the kitchen. At block 605, the method 600 may include repeatedly testing the integrity of a controller that controls the fire suppression system in the kitchen and which is operative to actuate the fire suppression system in response to a fire being detected in the kitchen. At block 607, the method 600 includes determining whether a fault is detected in the first solenoid or the second solenoid. At block 607, the method 600 includes disabling the appliance when a fault is detected in the first solenoid, the second solenoid, or the controller.

Figure 7:
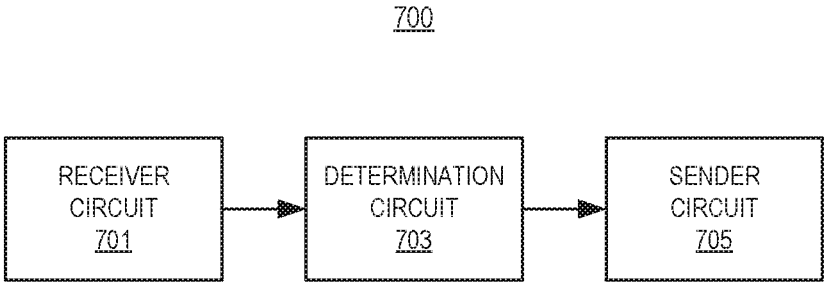
FIG. 7 illustrates one embodiment of a server for monitoring and controlling fire suppression systems in commercial kitchens in accordance with various aspects as described herein.

FIG. 7 illustrates one embodiment of a server 700 for monitoring and controlling fire suppression systems in commercial kitchens in accordance with various aspects as described herein. In FIG. 7, the server 700 may include a receiver circuit 701, a determining circuit 703, a sender circuit 705, the like, or any combination thereof. The receiver circuit 701 is configured to receive information via a network sent from a communication module 109 located on a site where a commercial kitchen is located. This information may include a fault with respect to a first electric solenoid valve or a fault with respect to a second electric solenoid valve. The first electric solenoid valve controls the flow of a fire suppression solution to at least one sprinkler head disposed over an appliance in the kitchen and is operative to spray the fire suppression solution onto the appliance in response to a fire being detected in the kitchen. Further, the fault with respect to the first solenoid valve results from repeatedly testing its integrity. The second electric solenoid valve controls the flow of a fire suppression solution to at least one sprinkler head disposed in an exhaust hood in the kitchen and is operative to spray the fire suppression solution into the exhaust hood in response to a fire being detected in the kitchen. Also, the fault with respect to the first solenoid valve results from repeatedly testing its integrity. The determination circuit 703 is configured to identify the fault and, for example, to determine whether the information received by the server indicates that a fault has been detected in the first solenoid valve, the second solenoid valve, or the controller. In addition, the sender circuit 705 is configured to send an indication when a fault has been detected.

Figure 8:
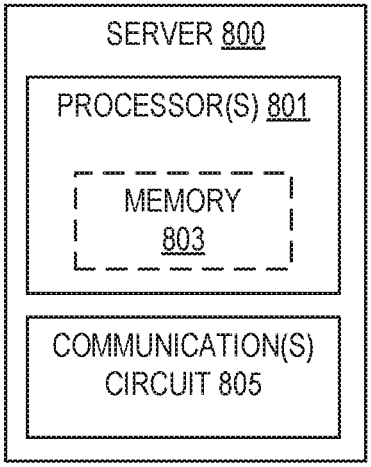
FIG. 8 illustrates another embodiment of a server for monitoring and controlling fire suppression systems in commercial kitchens in accordance with various aspects as described herein.

FIG. 8 illustrates another embodiment of a server for monitoring and controlling fire suppression systems in commercial kitchens in accordance with various aspects as described herein. In FIG. 8, the server 800 may include processing circuit(s) 801, communications circuit(s) 805, the like, or any combination thereof. The communication circuit(s) 805 may be configured to transmit or receive information to or from one or more network nodes over a network via any communication technology. The processing circuit(s) 301 may be configured to perform processing as described herein (e.g., the method of FIG. 11) such as by executing program instructions stored in memory 803. The processing circuit(s) 801 in this regard may implement certain functional means, units, or modules.

Figure 9:
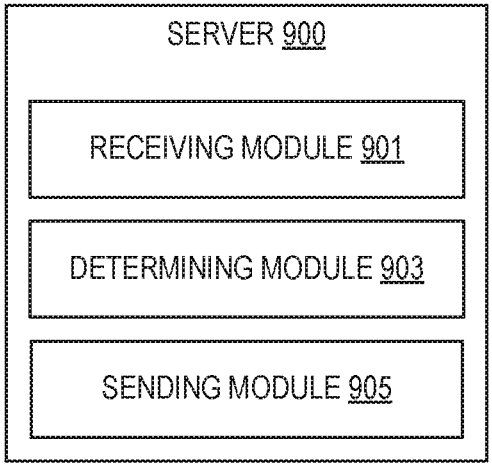
FIG. 9 illustrates another embodiment of a server for monitoring and controlling fire suppression systems in commercial kitchens in accordance with various aspects as described herein.

FIG. 9 illustrates another embodiment of a server 900 for monitoring and controlling fire suppression systems in commercial kitchens in accordance with various aspects as described herein. In FIG. 9, the server 900 may implement various functional means, units, or modules (e.g., via the processing circuit(s) 901 of FIG. 9 or via software code). These functional means, units, or modules (e.g., for implementing the method of FIG. 11) include a receiving module or unit 901 for receiving information via a network sent from a communication module located on a site where a commercial kitchen is located. This information may include a fault with respect to a first electric solenoid valve or a fault with respect to a second electric solenoid valve. The first electric solenoid valve controls the flow of a fire suppression solution to at least one sprinkler head disposed over an appliance in the kitchen and is operative to spray the fire suppression solution onto the appliance in response to a fire being detected in the kitchen. Further, the fault with respect to the first solenoid valve results from repeatedly testing its integrity. The second electric solenoid valve controls the flow of a fire suppression solution to at least one sprinkler head disposed in an exhaust hood in the kitchen and is operative to spray the fire suppression solution into the exhaust hood in response to a fire being detected in the kitchen. Also, the fault with respect to the first solenoid valve results from repeatedly testing its integrity. These functional means, units, or modules include a determining module or unit 903 for determining whether the information received by the server indicates that a fault has been detected in the first solenoid valve, the second solenoid valve, or the controller. These functional means, units, or modules include a sending module or unit 905 for sending an indication when a fault has been detected.

Figure 10:
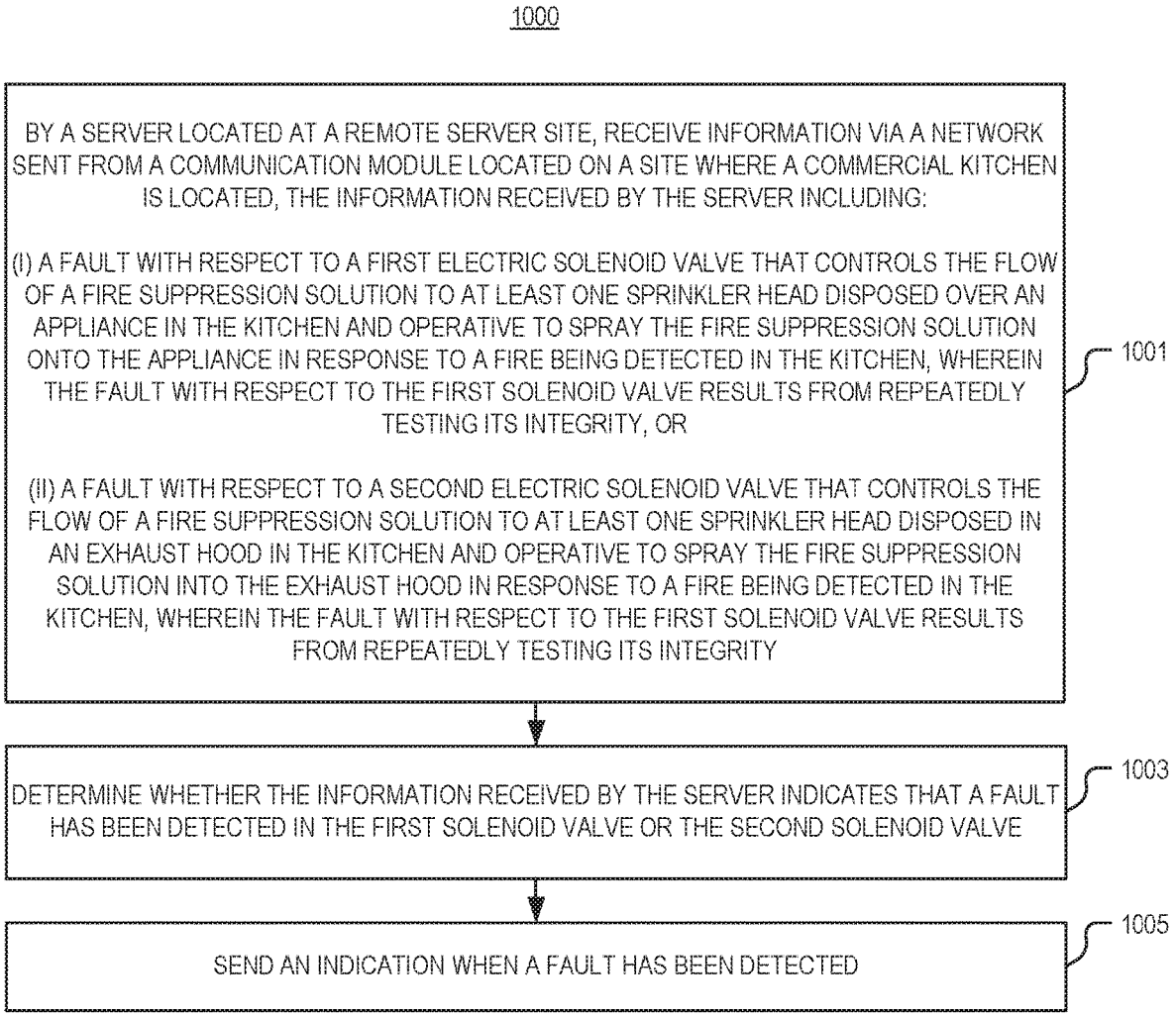
FIG. 10 illustrates one embodiment of a method performed by a server for monitoring and controlling fire suppression systems in commercial kitchens in accordance with various aspects as described herein.

FIG. 10 illustrates one embodiment of a method 1000 performed by a server for monitoring and controlling fire suppression systems in commercial kitchens in accordance with various aspects as described herein. In FIG. 10, the method 1000 may start, for instance, at block 1001 where it includes receiving information via a network sent from a communication module located on a site where a commercial kitchen is located. This information may include a fault with respect to a first electric solenoid valve or a fault with respect to a second electric solenoid valve. The first electric solenoid valve controls the flow of a fire suppression solution to at least one sprinkler head disposed over an appliance in the kitchen and is operative to spray the fire suppression solution onto the appliance in response to a fire being detected in the kitchen. Further, the fault with respect to the first solenoid valve results from repeatedly testing its integrity. The second electric solenoid valve controls the flow of a fire suppression solution to at least one sprinkler head disposed in an exhaust hood in the kitchen and is operative to spray the fire suppression solution into the exhaust hood in response to a fire being detected in the kitchen. Also, the fault with respect to the first solenoid valve results from repeatedly testing its integrity. At block 1003, the method 1000 includes determining whether the information received by the server indicates that a fault has been detected in the first solenoid valve, the second solenoid valve, or the controller. At block 1005, the method 1000 includes sending an indication when a fault has been detected.

Figure 11:
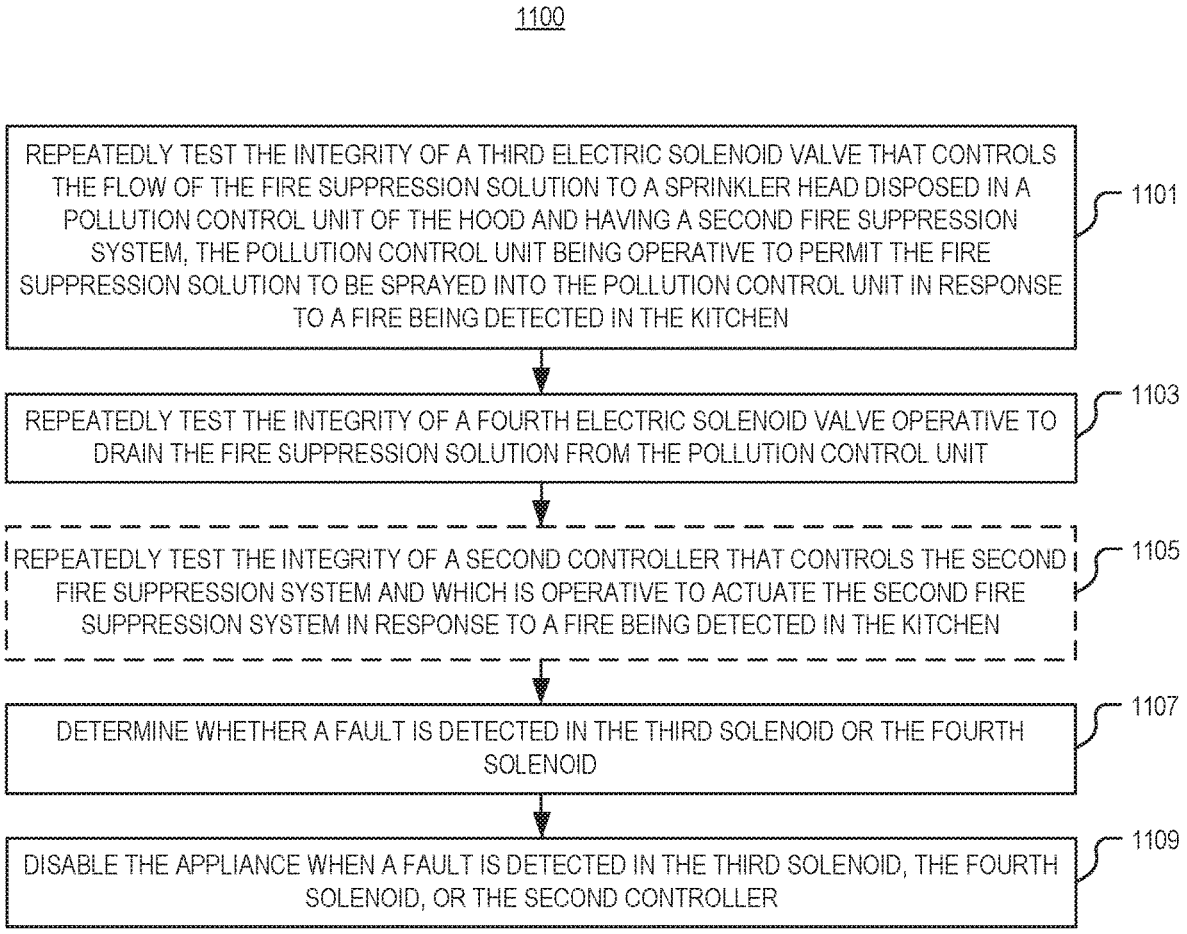
FIG. 11 illustrates another embodiment of a method performed by a controller for monitoring and controlling fire suppression systems in commercial kitchens in accordance with various aspects as described herein.

FIG. 11 illustrates another embodiment of a method 1100 performed by a controller for monitoring and controlling fire suppression systems in commercial kitchens in accordance with various aspects as described herein. In FIG. 11, the method 1100 may start, for instance, at block 1101 where it includes repeatedly testing the integrity of a third electric solenoid valve that controls the flow of the fire suppression solution to a sprinkler head disposed in a pollution control unit of the hood and having a second fire suppression system. Further, the pollution control unit is operative to permit the fire suppression solution to be sprayed into the pollution control unit in response to a fire being detected in the kitchen. At block 1103, the method 1100 includes repeatedly testing the integrity of a fourth electric solenoid valve operative to drain the fire suppression solution from the pollution control unit. At block 1105, the method 1100 may include repeatedly testing the integrity of a second controller that controls the second fire suppression system and which is operative to actuate the second fire suppression system in response to a fire being detected in the kitchen. At block 1107, the method 1100 includes determining whether a fault is detected in the third solenoid or the fourth solenoid. At block 1109, the method 1100 includes disabling the appliance when a fault is detected in the third solenoid, the fourth solenoid, or the second controller.

The fire suppression system 100 can be viewed as containing three parts. First, there is the portion of the fire suppression system that is designed to address a fire occurring in and around an exhaust hood or appliance. The second part of the fire suppression system is that portion that is aimed at addressing a fire in the pollution control unit 115. In some cases, there is a chemical component to the first suppression system and in that case, the fire suppression system is designed to respond to faults detected in the chemical fire suppression area.

In all three cases, a fault detection with respect to the main controller 103 is deemed a stage III or catastrophic fault. If a fault is detected in the controller 103, the gas valves supplying gas to gas fired components is shut down or closed. In addition, if there are electrical appliances and a fault in the controller 103 is detected, the fire suppression system 100 prevents electricity from being supplied to the appliance. In one embodiment, this is achieved by actuating a shutdown shunt trip breaker and UDS kill switch.

In addition to faults detected with respect to the controller 103, faults detected with respect to the first and second solenoid valves also are deemed stage III or catastrophic faults. In the event of a fault detected with respect to either the first solenoid valve or the second solenoid valve, gas and electricity is shut off from gas and electrical appliances. Also, faults detected with respect to the first and second solenoid valves trips a local trouble relay. That is, in some cases the fire suppression system 100 is provided with the local trouble relay. Basically this means that the fire suppression system 100 is communicatively connected to a fire panel of a building housing the commercial kitchen and fire system. Once there is a fault detected in the first or second solenoid valve, this local trouble relay is actuated and this can result in a local trouble alert being presented or occurring on the building fire panel. When faults are detected in certain elements of the fire suppression system, there will be emitted a local alarm. In some cases, the local alarm can be automatically reset within a certain period of time. That is not the case with respect to faults detected with respect to the first and second solenoid valves or the main controller 103.

In the case of the fire suppression system and the components thereof that are directed to the pollution control unit 115, if there is a fault detected with respect to the third or fourth solenoid valve, then this is considered a stage III or catastrophic fault. If a fault is detected with respect to the third or fourth solenoid valves, this results in a shutdown of the gas and electricity supplied to the appliances and also results in the local trouble relay being actuated.

Finally, in cases where the fire suppression system includes a chemical component, these systems would include a container for holding the chemical, a gas cylinder containing gas that delivers the chemical to a particular area and a release solenoid disposed between the container and the gas cylinder. Both the release solenoid and the gas cylinder are monitored for faults. A fault in either will automatically shut down the gas and/or electricity supplied to appliances in the kitchen and will actuate the local trouble relay.

In some embodiments, other elements of the fire suppression system are continuously monitored for faults. For example, the fire suppression system may detect ground faults, low surfactant levels, AC power failure, etc. Some of these faults are not deemed as serious as the stage III or catastrophic faults. However, some may still require that the supply of gas and electricity to the appliances be shut down.

The previous detailed description is merely illustrative in nature and is not intended to limit the present disclosure, or the application and uses of the present disclosure. Furthermore, there is no intention to be bound by any expressed or implied theory presented in the preceding field of use, background, summary, or detailed description. The present disclosure provides various examples, embodiments and the like, which may be described herein in terms of functional or logical block elements. The various aspects described herein are presented as methods, devices (or apparatus), systems, or articles of manufacture that may include a number of components, elements, members, modules, nodes, peripherals, or the like. Further, these methods, devices, systems, or articles of manufacture may include or not include additional components, elements, members, modules, nodes, peripherals, or the like.

Furthermore, the various aspects described herein may be implemented using standard programming or engineering techniques to produce software, firmware, hardware (e.g., circuits), or any combination thereof to control a computing device to implement the disclosed subject matter. It will be appreciated that some embodiments may be comprised of one or more generic or specialized processors such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the methods, devices and systems described herein. Alternatively, some or all functions could be implemented by a state machine that has no stored program instructions, or in one or more application specific integrated circuits (ASICs), in which each function or some combinations of certain of the functions are implemented as custom logic circuits. Of course, a combination of the two approaches may be used. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The term "article of manufacture" as used herein is intended to encompass a computer program accessible from any computing device, carrier, or media. For example, a computer-readable medium may include: a magnetic storage device such as a hard disk, a floppy disk or a magnetic strip; an optical disk such as a compact disk (CD) or digital versatile disk (DVD); a smart card; and a flash memory device such as a card, stick or key drive. Additionally, it should be appreciated that a carrier wave may be employed to carry computer-readable electronic data including those used in transmitting and receiving electronic data such as electronic mail (e-mail) or in accessing a computer network such as the Internet or a local area network (LAN). Of course, a person of ordinary skill in the art will recognize many modifications may be made to this configuration without departing from the scope or spirit of the subject matter of this disclosure.

Throughout the specification and the embodiments, the following terms take at least the meanings explicitly associated herein, unless the context clearly dictates otherwise. Relational terms such as "first" and "second," and the like may be used solely to distinguish one entity or action from another entity or action without necessarily requiring or implying any actual such relationship or order between such entities or actions. The term "or" is intended to mean an inclusive "or" unless specified otherwise or clear from the context to be directed to an exclusive form. Further, the terms "a," "an," and "the" are intended to mean one or more unless specified otherwise or clear from the context to be directed to a singular form. The term "include" and its various forms are intended to mean including but not limited to. References to "one embodiment," "an embodiment," "example embodiment," "various embodiments," and other like terms indicate that the embodiments of the disclosed technology so described may include a particular function, feature, structure, or characteristic, but not every embodiment necessarily includes the particular function, feature, structure, or characteristic. Further, repeated use of the phrase "in one embodiment" does not necessarily refer to the same embodiment, although it may. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A device or structure that is "configured" in a certain way is configured in at least that way, but may also be configured in ways that are not listed.

What is claimed is:

1. A method of detecting faults in a fire suppression systems situated in a commercial kitchen and shutting down a kitchen appliance in the commercial kitchen in response to detecting the faults, the method comprising:

repeatedly testing the integrity of a first electric solenoid valve that controls the flow of a fire suppression solution to at least one sprinkler head disposed over the kitchen appliance in the commercial kitchen and operative to spray the fire suppression solution onto the kitchen appliance in response to the detection of a fire in the commercial kitchen;

repeatedly testing the integrity of a second electric solenoid valve that controls the flow of the fire suppression solution to at least one sprinkler head disposed in an exhaust hood disposed over the kitchen appliance and operative to spray the fire suppression solution into the exhaust hood in response to a fire being detected in the commercial kitchen;

repeatedly testing the integrity of a controller that controls the fire suppression system in the commercial kitchen and which is operative to actuate the ire suppression system in response to a fire being detected in the commercial kitchen; and wherein when the fault is detected in the first electric solenoid valve, the second electric solenoid valve, or the controller, the method includes disabling the kitchen appliance; and wherein the commercial kitchen includes a pollution control unit downstream of the exhaust hood for removing contaminants from vapor exhausted by the exhaust hood and wherein there is a second fire suppression system located in the pollution control unit and wherein the method at the pollution control unit comprises:

repeatedly testing the integrity of a third electric solenoid valve that controls the flow of the fire suppression solution to a sprinkler head in the pollution control unit and which is operative to permit the fire suppression solution to be sprayed into the pollution control unit in response to a fire being detected in the commercial kitchen;

repeatedly testing the integrity of a fourth electric solenoid valve operative to drain the fire suppression solution from the pollution control unit;

repeatedly testing the integrity of a second controller that controls the second fire suppression system and which is operative to actuate the second fire suppression system in response to a fire being detected in the commercial kitchen; and wherein when there is fault detected in the third electric solenoid valve, the fourth electric solenoid valve or the second controller, the method includes disabling the kitchen appliance.

2. The method of claim 1 including actuating a local trouble relay associated with a building housing the commercial kitchen in response to a fault being detected in the first electric solenoid valve, the second electric solenoid valve, or the controller.

3. The method of claim 1 wherein when a fault is detected in either the first electric solenoid valve, the second electric solenoid valve or the controller, the method includes directing information indicating a detected fault from a communication module associated with the commercial kitchen via the internet to one or more remote servers which, in response to receiving the information indicating a fault, issues an alert to at least one interested party.

4. A method of remotely monitoring a plurality of fire suppression systems situated in a plurality of commercial kitchens located at different geographic locations, detecting faults in selected components of a fire suppression systems, and issuing alerts to interested parties in response to the detection of faults, the method comprising:

receiving, by one or more servers located on a remote site, information via the internet from a plurality of communication modules located on various sites where commercial kitchens are located, and wherein there is at least one communications module located at each commercial kitchen site and associated with the commercial kitchen located at that site, the information received by the one or more servers from each communication module comprising:

i. fault status report with respect to a first solenoid valve that controls the flow of a fire suppression solution to at least one sprinkler head disposed over an appliance in one of the commercial kitchens and operative to spray the fire suppression solution onto the appliance in response to the detection of a fire in one of the commercial kitchens, and wherein the fault status report with respect to the first solenoid valve results from repeatedly testing the integrity of the first solenoid valve;

ii. fault status report with respect to a second solenoid valve that controls the flow of the fire suppression solution to at least one sprinkler head disposed in an exhaust hood in one of the commercial kitchens and operative to spray the fire suppression solution into the exhaust hood in response to a fire being detected in one of the commercial kitchens, and wherein the fault status report with respect to the second solenoid valve results from repeatedly testing the integrity of the second solenoid valve;

iii. fault status report with respect to a third solenoid valve associated with a pollution control unit located downstream from the exhaust hood wherein the third solenoid valve controls the flow of the fire suppression solution from at least one sprinkler head into the pollution control unit and is operative to spray the fire suppression solution into the pollution control unit in response to the detection of a fire in one of the commercial kitchens, and wherein the fault status report with respect to the third solenoid valve results from repeatedly testing the integrity of the third solenoid valve;

iv. a fault status report with respect to a fourth solenoid valve associated with a drain line in the pollution control unit and which controls the flow of the fire suppression solution from the pollution control unit and through the drain line, and wherein the fault status report with respect to the fourth solenoid valve results from repeatedly testing the integrity of the fourth solenoid valve;

v. fault status report with respect to a controller associated with one of the commercial kitchens that controls the fire suppression system in one of the commercial kitchens and which is operative to actuate the fire suppression system in one of the commercial kitchens in response to a fire detected in one of the commercial kitchens, and wherein the fault status report with respect to the controller results from repeatedly testing the integrity of the controller;

vi. issuing an alert to at least one interested party in response to the information received by the one or more servers from the communications module indicating that a fault has been detected in one of the commercial kitchens with respect to the first solenoid valve, the second solenoid valve, the third solenoid, the fourth solenoid valve, or the controller.

* * * * *